US006848349B2

(12) United States Patent
Tramontina et al.

(10) Patent No.: US 6,848,349 B2
(45) Date of Patent: Feb. 1, 2005

(54) METHOD OF CUTTING A MATERIAL FROM A ROLLED PRODUCT

(75) Inventors: Paul F. Tramontina, Alpharetta, GA (US); Richard P. Lewis, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 179 days.

(21) Appl. No.: 10/035,645

(22) Filed: Dec. 28, 2001

(65) Prior Publication Data

US 2003/0121379 A1 Jul. 3, 2003

(51) Int. Cl.[7] ..... B26F 3/02; B26D 5/38

(52) U.S. Cl. ..... 83/13; 225/72

(58) Field of Search ..... 83/649, 225.22, 83/13, 544, 628; 225/52, 72, 77, 20, 19, 73, 74, 75, 76, 1; 30/353

(56) References Cited

U.S. PATENT DOCUMENTS

| | | | | |
|---|---|---|---|---|
| 515,849 | A | 3/1894 | Wheeler | |
| 1,135,859 | A * | 4/1915 | Stamirowski | 225/72 |
| 2,095,419 | A | 10/1937 | Pollard | |
| 2,555,885 | A | 6/1951 | Hope | |
| 2,636,691 | A * | 4/1953 | Fritzenger | 242/564.1 |
| 2,643,069 | A | 6/1953 | Carlin | |
| 2,663,369 | A * | 12/1953 | Erhardt | 225/20 |
| 2,819,852 | A | 1/1958 | Sarro. | |
| 2,879,012 | A | 3/1959 | Sarro | |
| 2,905,404 | A | 9/1959 | Simmons | |
| 2,948,486 | A | 8/1960 | Epeneter | |
| 3,729,145 | A | 4/1973 | Koo et al. | |
| 3,991,923 | A * | 11/1976 | Nishikawa | 225/20 |
| 4,085,878 | A * | 4/1978 | Nausedas | 225/19 |
| 4,119,251 | A | 10/1978 | Golner et al. | |
| D283,188 | S | 4/1986 | Pool | |
| 4,586,639 | A * | 5/1986 | Ruff et al. | 225/1 |
| 4,762,586 | A * | 8/1988 | Wilkie | 156/527 |
| 4,826,063 | A * | 5/1989 | Ban | 225/52 |
| D310,758 | S | 9/1990 | Breger | |
| 5,024,362 | A | 6/1991 | Karlsson | |
| D326,580 | S | 6/1992 | Brazis | |
| D327,193 | S | 6/1992 | Crook et al. | |
| 5,161,723 | A | 11/1992 | Wirtz-Odenthal | |
| 6,170,726 | B1 * | 1/2001 | Jensen | 225/12 |
| 6,267,323 | B1 | 7/2001 | Phelps et al. | |

FOREIGN PATENT DOCUMENTS

EP WO 01/43613 A1 6/2001

* cited by examiner

*Primary Examiner*—Allan N. Shoap
*Assistant Examiner*—Ghassem Alie
(74) *Attorney, Agent, or Firm*—Scott B. Garrison

(57) ABSTRACT

A dispenser for dispensing a material from a cored roll comprises a housing having a plurality of walls forming an interior volume and an opening, at least one pair of coaxially aligned, opposed plungers mounted on opposite walls within the dispenser, and a cutting mechanism. The cutting mechanism includes a blade, a cover for alternately exposing and concealing the blade, and a slidable panel for actuating the cover.

3 Claims, 14 Drawing Sheets

METHOD OF CUTTING A MATERIAL FROM A ROLLED PRODUCT

The present invention relates to cutting mechanisms for dispensers of rolled products, and more particularly to cutting mechanisms and dispensers having features that permit simple and easy loading of a roll of material into the dispenser and dispensing therefrom.

Dispensing of rolled paper products such as paper toweling, bathroom tissue, and the like is common in commercial facilities such as airports, manufacturing plants, and shopping malls. Rolled paper products are dispensed in different areas within these facilities, such as restrooms and work areas. In such facilities, it is important to use maintenance personnel in an efficient manner, including minimizing both the number of visits maintenance personnel must make to these locations as well as the amount of time expended tending to the dispensers on each visit.

To install a roll of material into many of the currently available dispensers, maintenance personnel must thread a leading edge of the rolled paper product through a series of rollers so that the product dispenses properly. Additionally, some dispensers require that the roll of paper product be installed in the dispenser so that the roll rotates in a particular direction. If the roll of paper product is not loaded correctly, the product may not be dispensed properly. Such dispensers require maintenance personnel to spend additional time ensuring that the roll of paper product is loaded correctly into the dispenser and threaded properly through the dispensing mechanism. Thus, it is desirable to utilize a dispenser that permits rolls of paper product to be easily and correctly loaded into the dispenser in a rapid and efficient manner.

It is also beneficial to provide an improved cutting mechanism for the dispenser. The mechanism must be capable of consistently cutting the material from the roll so that dispensing is not impeded.

SUMMARY OF THE INVENTION

One aspect of the present invention discloses a cutting mechanism which includes a blade, a rigid member, and a cover. The rigid member has a first end and is slidable in at least one direction at the first end. The cover is adapted to alternately expose and conceal the blade. The cover is actuated by slidably biasing the first end of the rigid member into the cover thereby causing the cover to retract and expose the blade.

In another aspect, a dispenser for dispensing a material from a cored roll is disclosed. In this embodiment the dispenser contains a housing having a plurality of walls with an opening therein. The walls serve in part to form an interior volume. At least one pair of opposed plungers is mounted on opposite walls within the interior volume in substantially coaxially aligned, spaced apart relation. The dispenser also contains a cutting mechanism which includes a blade, a panel having a pivotable end and a sheet contact end, and a cover for alternately exposing and concealing the blade. The panel is pivotably attached to at least one wall within the interior of the housing at the pivotable end so that the panel is disposed between the opening and the pair of opposed plungers. Moreover, the panel is slidable in at least one direction at the pivotable end.

In still another aspect of the invention, a dispenser includes a housing having a plurality of walls with an opening and an interior volume. A blade is mounted proximal to the opening. A rigid member is movably mounted to at least one wall within the interior of the housing at a pivotable end. The rigid member also has a sheet contact end distal to the pivotable end. The pivotable end is slidably movable from a first to a second position with respect to the housing and is further at least partially pivotable about the pivotable end. This embodiment of the dispenser also includes a cover for alternately exposing and concealing the blade. The cover has a rigid member contact end.

In yet another aspect of the present invention, a dispenser includes a housing having a plurality of walls with an opening and an interior volume. At least one pair of opposed plungers is mounted on opposite walls within the interior volume in substantially coaxially aligned, spaced apart relation. The dispenser also contains a cutting mechanism which includes a blade, a panel having a first end and a second end, and a cover for alternately exposing and concealing the blade. In this embodiment, the panel is disposed between the opening and the pair of opposed plungers. The panel is also slidable in at least one direction at the first end. The cover has a panel contact end that is actuated by the first end of the panel slidably engaging the panel contact end of the cover thereby causing the blade to be exposed. Further, at least one of the plungers contains a plunger actuating surface which is disposed substantially toward the opening, and a roll bearing surface which is disposed substantially radially opposite the plunger actuating surface. This plunger is adapted to retract inwardly and away from its opposing paired plunger.

DESCRIPTION OF THE INVENTION

Figure 1:
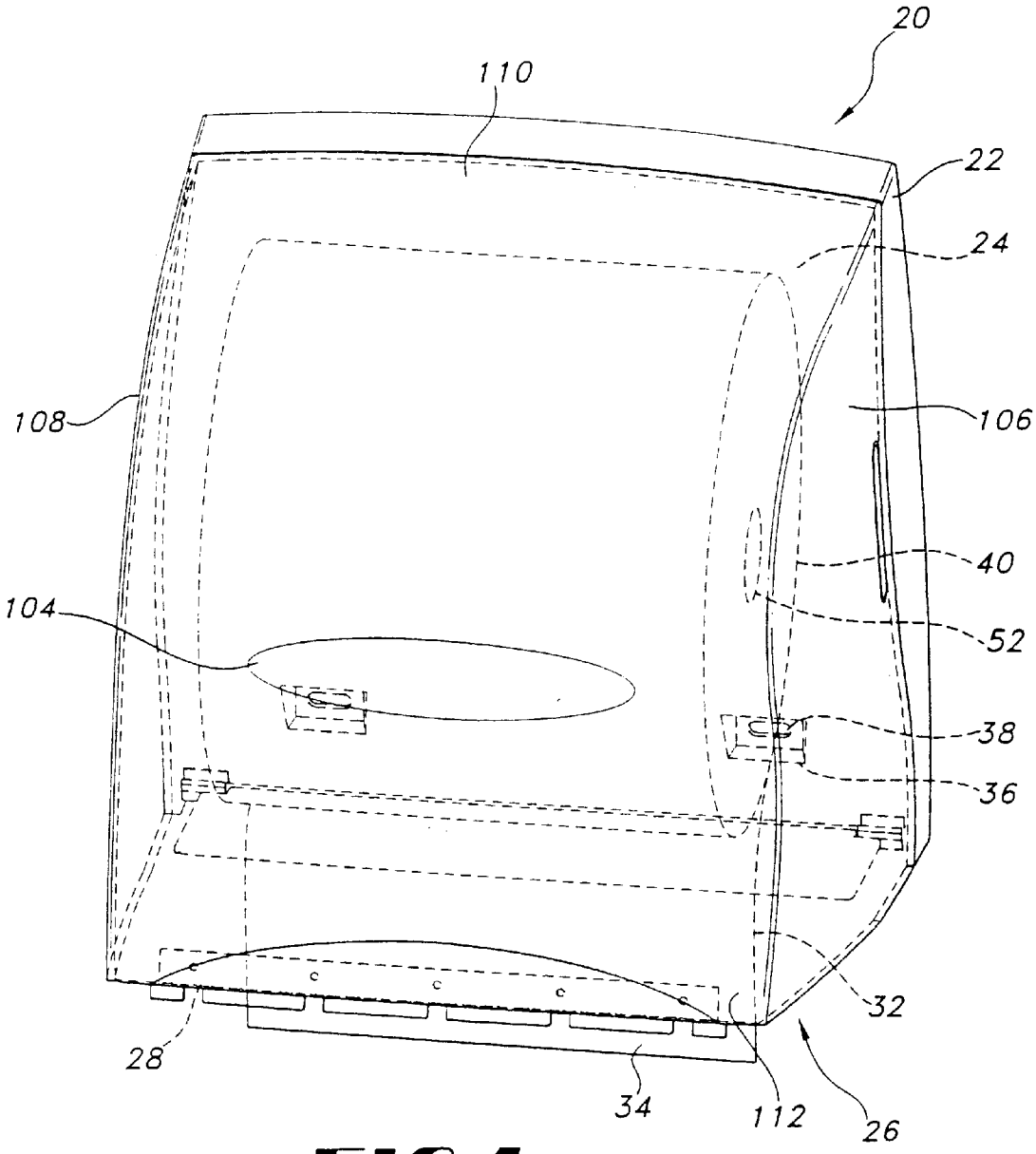
FIG. 1 is a perspective view of the dispenser.

The present invention relates to a dispenser of rolled materials, such as, for example, rolled paper products. An embodiment of a dispenser according to the present invention is depicted in FIG. 1. A dispenser 20 is shown which includes a housing 22 defined at least in part by a plurality of walls 106, 108, 110, and 112, the walls defining an interior volume 24 and having an opening 26 therethrough. A roll 40 of a material 32 is contained within and dispensed from the interior volume 24 of the housing 22. Tail 34 of the material 32 extends from the opening 26 and allows users to remove the material 32 from the housing 22. A blade 28 at a lower margin of the housing 22 serves as a tear point for material 32 dispensed from the housing 22. The housing 22 is typically mounted on or to a rigid surface such as, for example, a restroom wall or stall. One possible manner of mounting the housing 22 to such a surface may include providing mounting blocks 36 having fastener holes 38 on the dispenser 20. Alternative methods of mounting the housing 22 are possible and will be known to those skilled in the art. The dispenser 20 may optionally have a window 104 made of translucent or transparent material for viewing the roll 40 as it is depleted.

Figure 2:
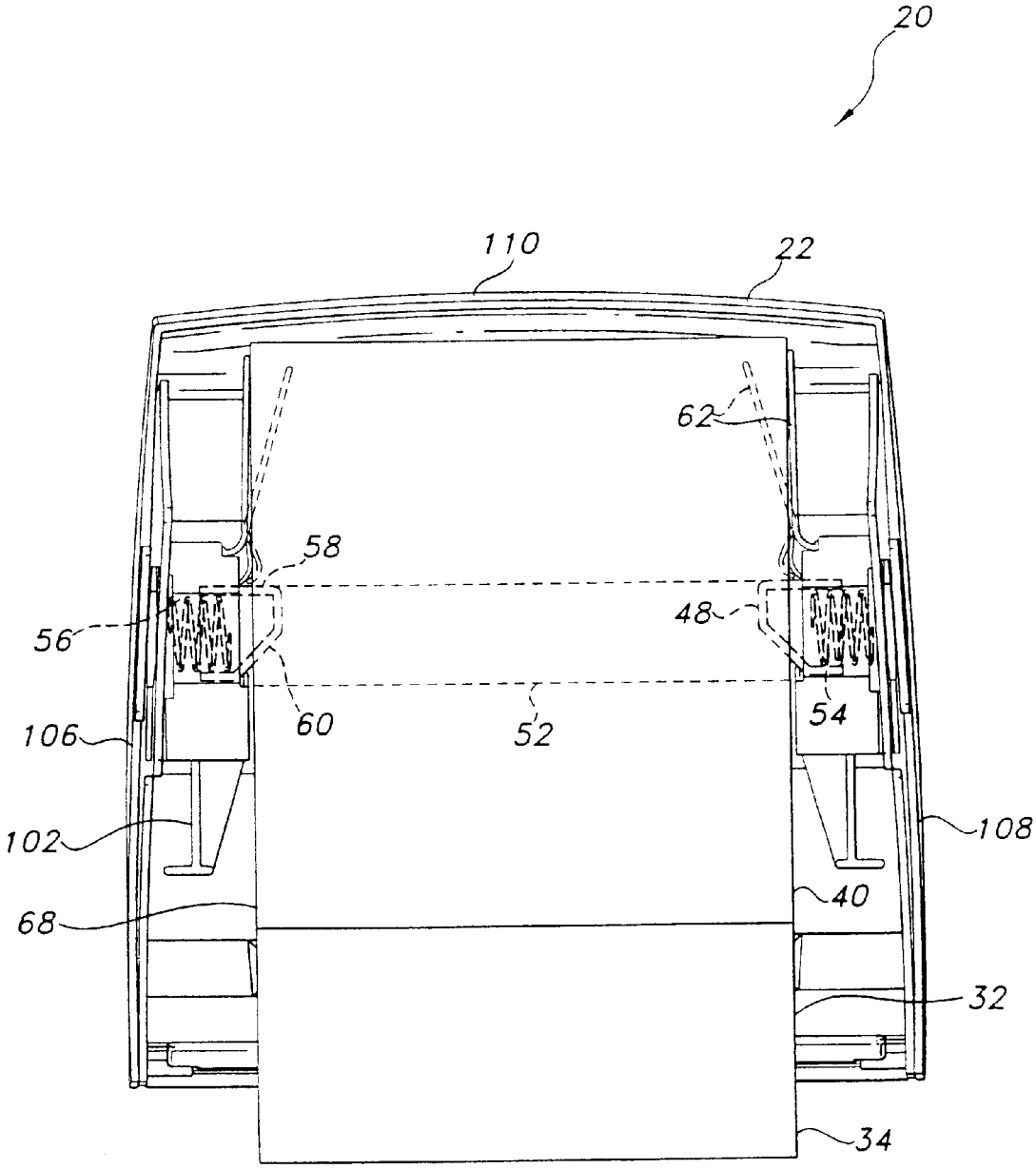
FIG. 2 shows a front elevational view of the dispenser.
Figure 3:
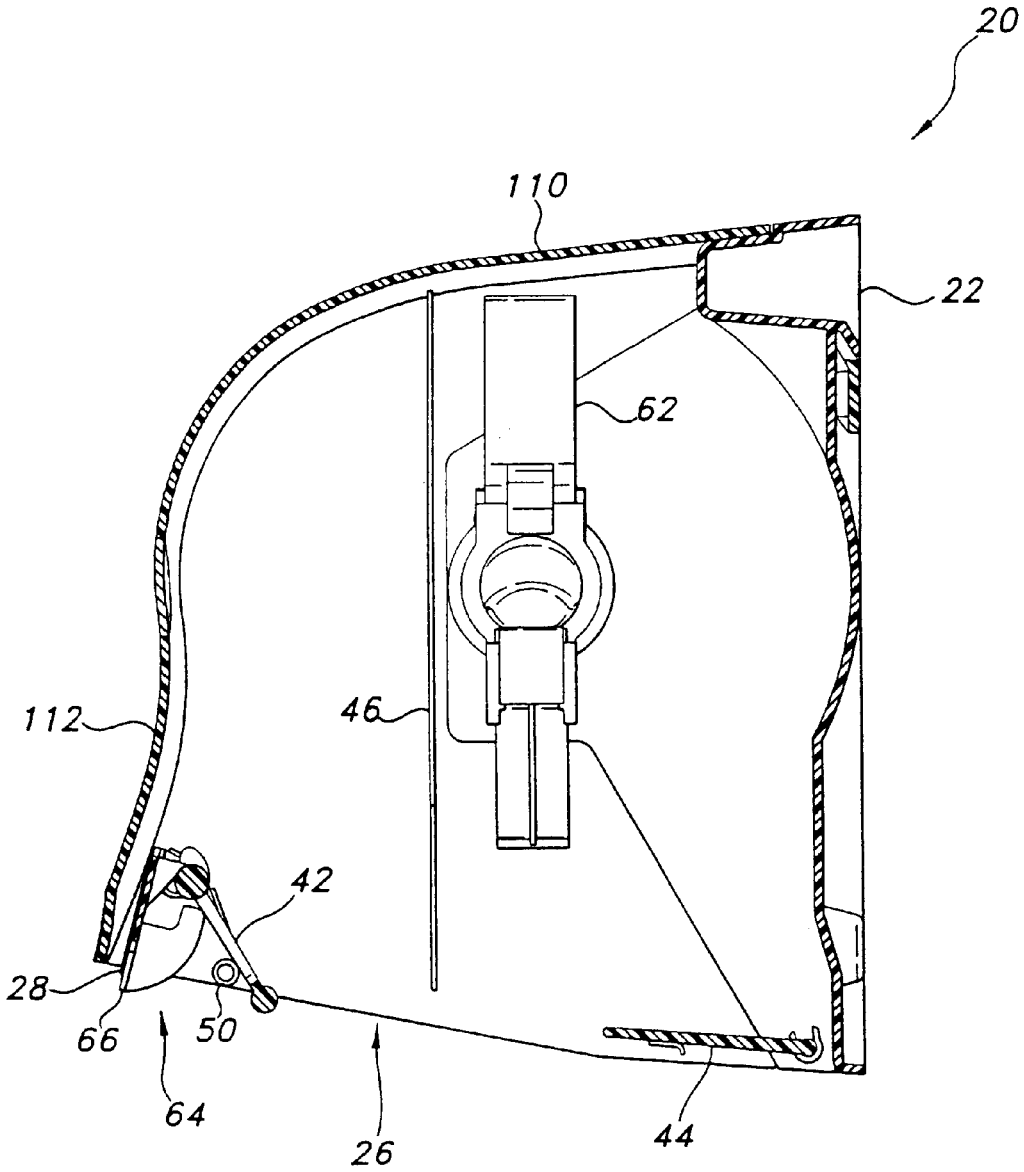
FIG. 3 depicts a cross-sectional end view of the dispenser.

FIG. 2 and FIG. 3 depict one embodiment of the dispenser 20 having a panel 42 and a door 44, pivotably mounted to rotate from an open position to accommodate the insertion of the roll 40, to a closed position in which the panel 42 and door 44 act to suspend the tail 34 within reach by the user. Angular guides 46 may be provided within the housing 22 to assist in directing the roll 40 during loading. At least one pair of opposed plungers 48 mounted on opposite walls 106 and 108 (FIG. 2) within the interior 24 in coaxially aligned, spaced apart relation extend into a core 52 of a roll 40 and provide a fixed mounting axis upon which the core 52 of the roll 40 rests and from which the material 32 is dispensed. The plungers 48 are designed to engage the core 52 of the roll 40.

In one possible configuration, the plungers 48 may be depressed against a spring 54, causing the spring 54 to be compressed inside a cavity 56. In this embodiment, the plungers 48 may have a roll bearing surface 58, upon which the core 52 rests, and an actuating surface 60. The geometry of the actuating surface 60 working in conjunction with sides 68 of the roll 40 facilitates both insertion and removal of the roll 40, as will be discussed in connection with FIG. 4 and FIG. 5. Other possible embodiments exist and will be known to those skilled in the art. Such embodiments are contemplated in the present invention. Brake springs 62 contiguous to the roll 40 may be utilized to provide a frictional and compressive force to retard overspinning of the roll 40 during dispensing. The dispenser 20 also provides a cutting mechanism 64 having a cover 66.

Figure 4:
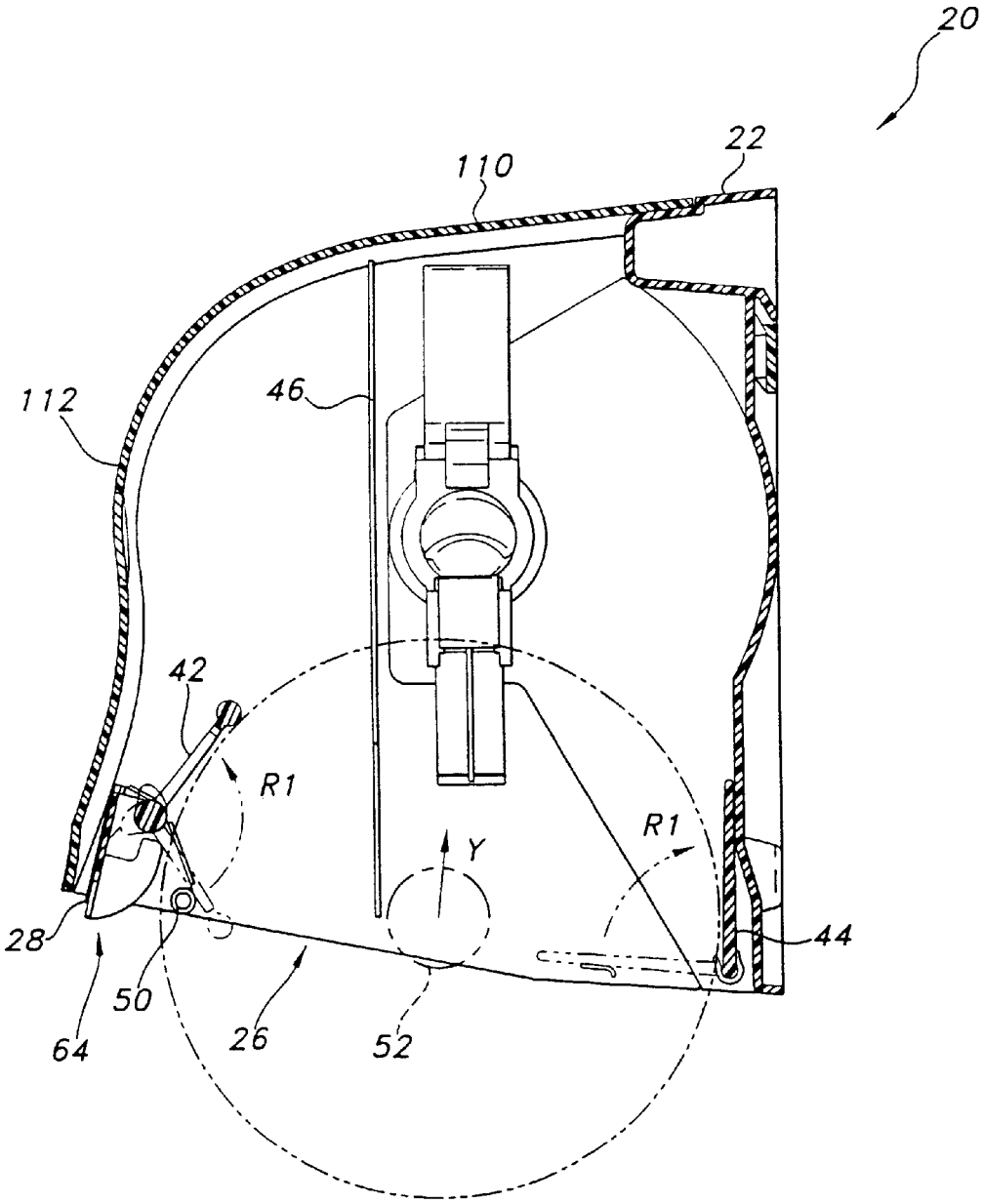
FIG. 4 shows cross-sectional end view of loading a dispenser.
Figure 5:
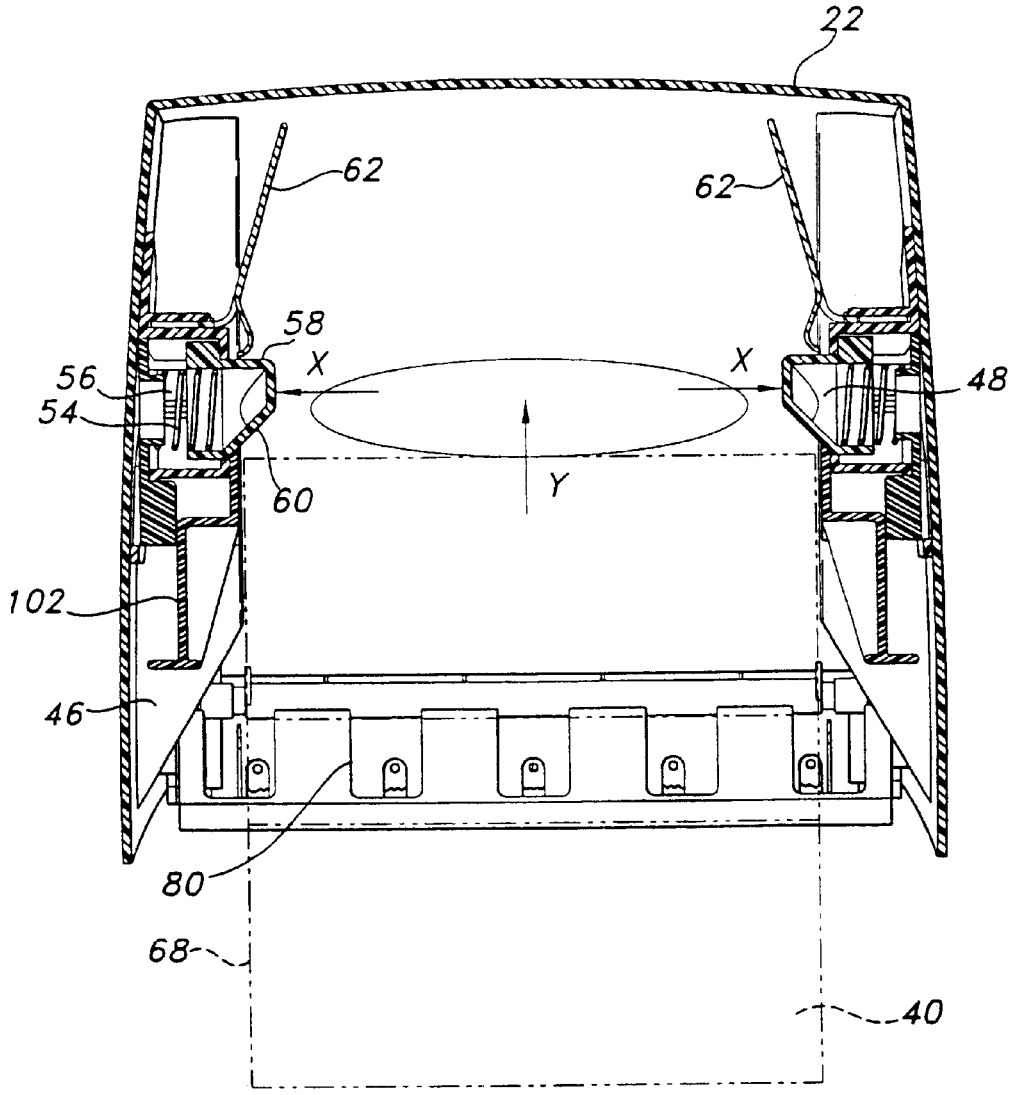
FIG. 5 shows a cross-sectional view of loading a dispenser.

FIG. 4 and FIG. 5 depict insertion of the roll 40 into the dispenser 20. In the embodiment depicted, the roll 40 may be held so that the core 52 is somewhat parallel to the dispenser opening 26. The roll 40 may be oriented so that it rotates in either a clockwise or a counterclockwise direction, so that unlike some prior art apparatuses, the direction in which the roll pays out the material 32 is not critical to proper operation.

Looking specifically to FIG. 4, it can be seen that as the roll 40 is moved into the housing 22 in a direction Y, the panel 42 and door 44 are progressively pushed in a direction R1 away from the opening 26 and toward the interior 24 of the housing 22. In embodiments in which no door 44 is provided, the panel 42 alone pivots about a pivotable end 72, shown in FIG. 7, such that a large roll may be inserted into the dispenser 20 through the opening 26. When a smaller roll 40 is used, the panel 42 may not need to pivot to a fully vertical position to enable the roll 40 to pass through the opening 26.

In either case, as the roll 40 advances into the housing 22, the roll 40 is urged toward the opposed plungers 48 in the direction Y by, for example, the angular guides 46 (FIG. 5). As the roll 40 is pushed further into the dispenser 20, the roll 40 clears the panel 42 and door 44 which then return to their original positions resting against panel stops 50. The use of doors 44 in some embodiments may be desirable to better protect the roll 40 from the outside elements and to create an appropriate path for dispensing. It is envisioned that the panel 42 and the door 44 can be made to return to their original positions through gravity or by some positive biasing force such as a spring mechanism (not shown).

Looking now to FIG. 5, it can be seen that both plungers 48 are depicted having an actuating surface 60. However, it should be understood that only one plunger 48 need be configured with an actuating surface 60 having a geometry adapted to depress upon contact with the sides 68 of the roll 40 as it is pushed upward into the dispenser 20. In some embodiments, at least one plunger 48 has the plunger actuating surface 60 disposed substantially toward the opening 26 and the roll bearing surface 58 disposed substantially radially opposite the plunger actuating surface 60. Additionally, at least one plunger 48 retracts inwardly in a direction X away from its opposing paired plunger 48 such that application of a biasing force to the plunger actuating surface 60 causes the roll bearing surface 58 to be shielded. Removal of the biasing force causes the plunger 48 to protrude toward its opposing paired plunger 48 thereby exposing the roll bearing surface 58. Such a biasing force may be applied by insertion or removal of the roll 40 as described, or by use of a release bar 102, which will be discussed in connection with FIG. 14 and FIG. 15.

Figure 6:
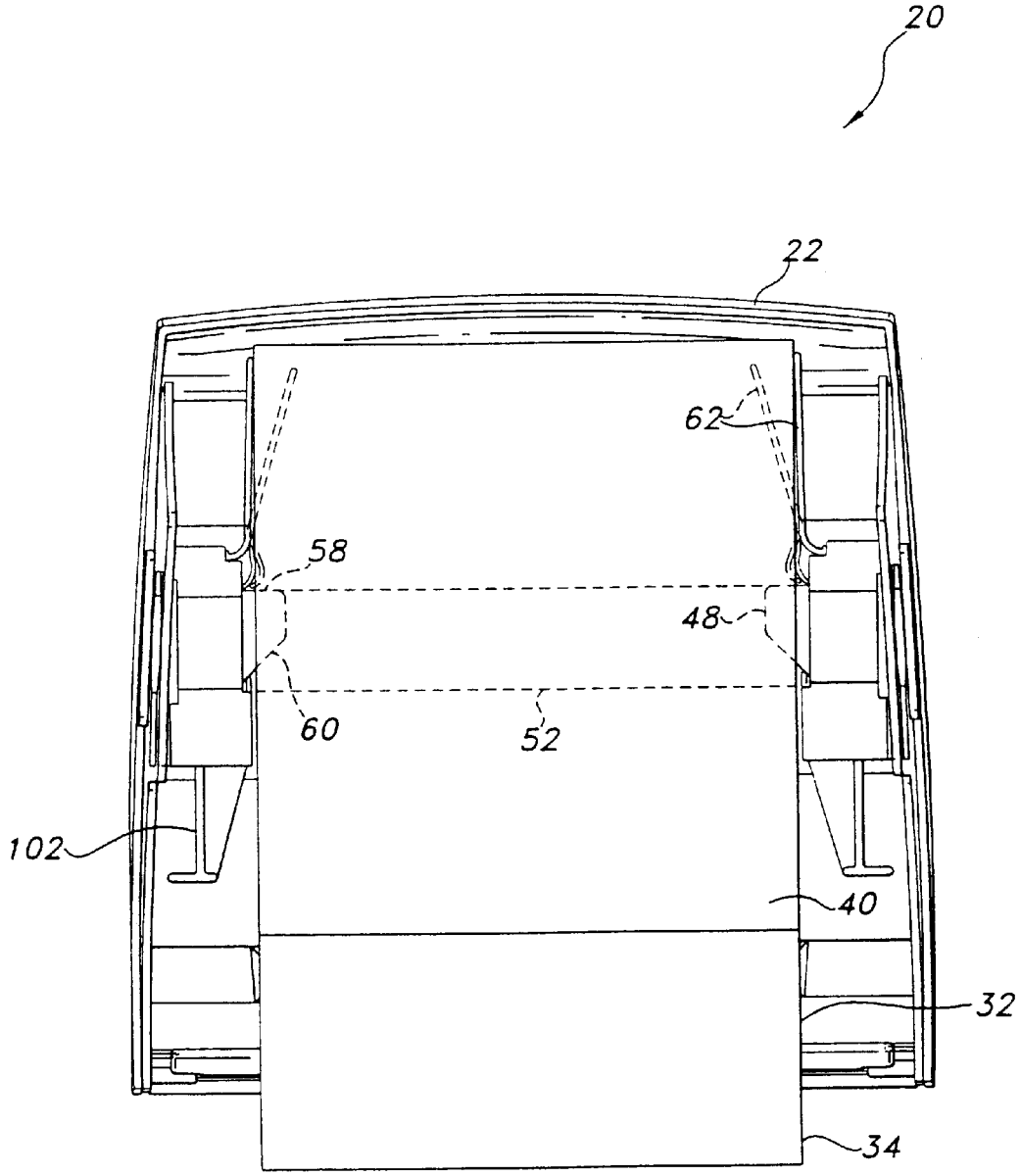
FIG. 6 depicts a roll mounted in the dispenser.

FIG. 6 shows the roll 40 mounted within the housing 22. As can be seen, the plungers 48 are now fully engaged in the core 52 of the roll 40. Since the roll 40 may be inserted in either direction, it may rotate in either a clockwise or a counterclockwise direction. As a result, the tail 34 may hang adjacent to the panel 42 (FIG. 3) or against the door 44 (FIG. 3). The roll 40 is supported by the roll bearing surface 58 of the plungers 48, which serve in part to provide a fixed mounting axis from which the material 32 may be dispensed from the roll 40. In at least one possible embodiment, the bearing surface 58 of one or more of the plungers 48 is substantially parallel to the core 52 of the roll 40. In another embodiment, one or more of the plungers 48 may have a different bearing surface geometry. For example, one possible configuration is to shape the bearing surface so that it slopes toward the opening 26.

Figure 7:
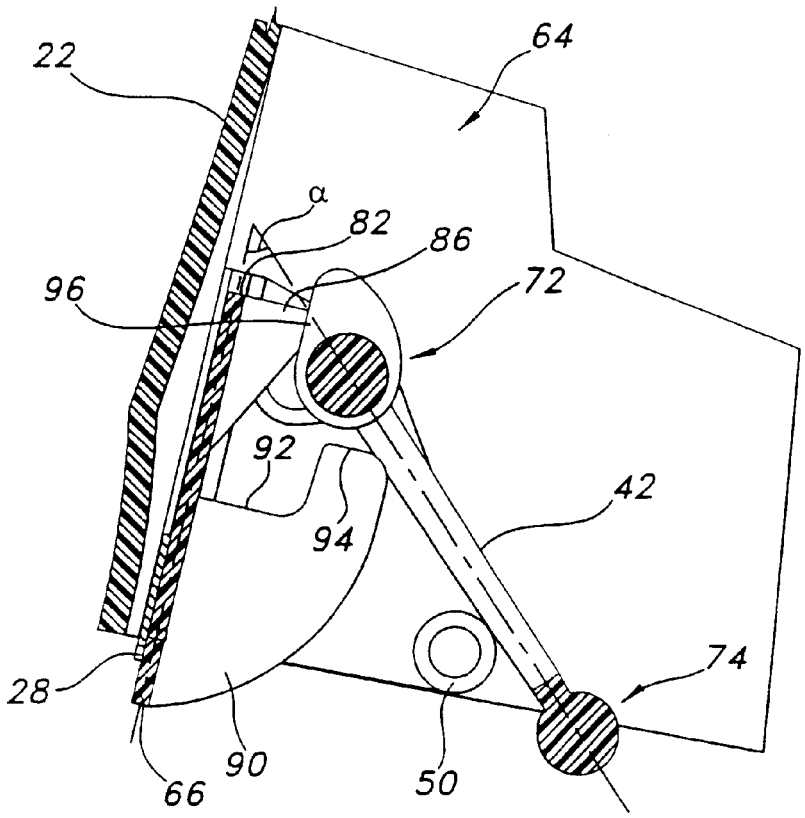
FIG. 7 depicts an end view of a cutting mechanism when not in use.
Figure 8:
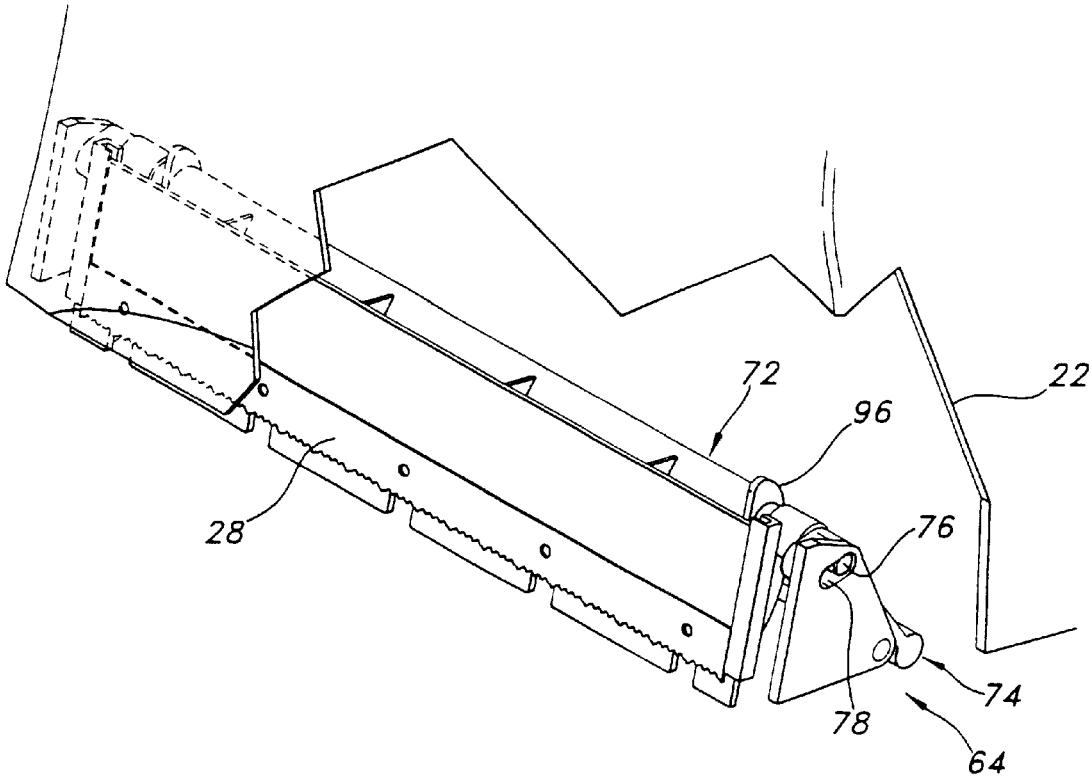
FIG. 8 is a perspective view of a cutting mechanism including the dispenser housing.
Figure 9:
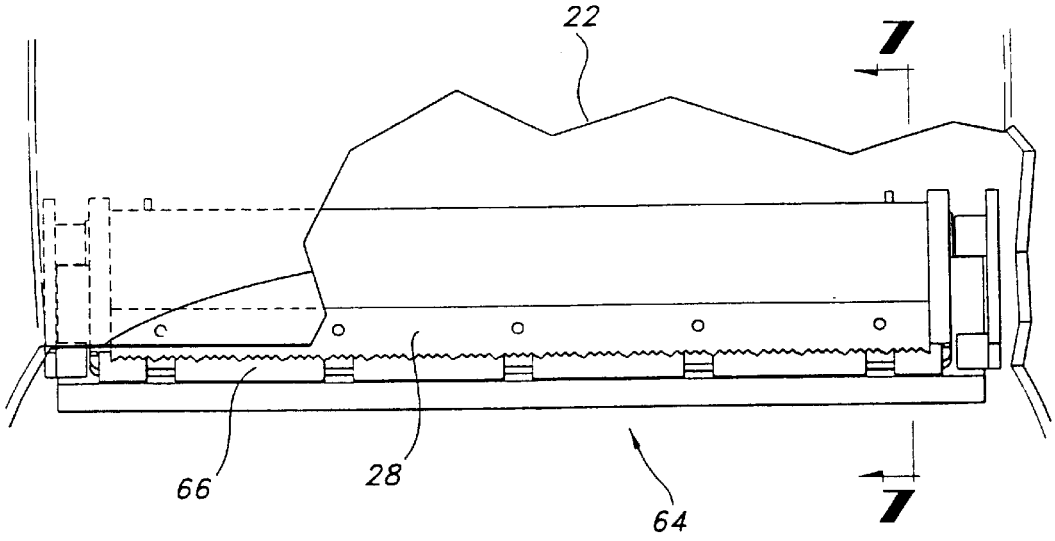
FIG. 9 is a front view of the cutting mechanism including the dispenser housing.

FIGS. 7 through 9 depict one exemplary embodiment of the cutting mechanism 64.

The cutting mechanism 64 generally includes the panel 42, the blade 28, and the cover 66. The panel 42 (FIG. 7) includes a first end 72 and a second end 74. In some embodiments, the panel 42 is disposed between the opening 26 and the pair of opposed plungers 48. The panel 42 may be both slidable in at least one direction and pivotable at the first end 72. In some embodiments, the panel 42 may also serve as an additional door as previously discussed above with respect to FIG. 4.

In certain embodiments the panel 42 is pivotably and slidably attached at the first end 72 to at least one wall 106 (FIG. 1) and in some embodiments, two walls such as opposing walls 1 06 and 108 within the interior volume 24 of the housing 22. One possible manner in which to accomplish this is to provide at least one protrusion 76 (FIG. 8) which is sized to fit within a channel 78 located on the wall 106 of the housing 22. To accommodate both a pivoting and sliding motion, the channel 78 can be made oblong so as to form a slot within which the protrusion 76 may be made to slide.

Alternatively, two such channels 78 can be provided to engage two such protrusions 76 (best seen in FIG. 8) located at opposite ends of the first end 72. Other embodiments are of course envisioned and will be known to those skilled in the art. One possibility being that the protrusions 76 are located on the side wall or side walls of the housing 22 whereas the channels 78 are located on the panel 42.

The second end 74 of the panel 42 may serve as a sheet contact end for actuating the cutting mechanism 64 during dispensing of the material 32. In some embodiments, the second end 74 may possess a drag surface 88 as shown on FIG. 11 to increase friction between the second end 74 and the material 32 as it is pulled across the second end 74. The drag surface 88 may be made from any material that increases the dynamic coefficient of friction between the second end 74 and the material 32. Any appropriate material may be selected for this purpose. The material may be applied adhesively, it may be embedded within or coated upon the sheet contact end in some fashion such as a stripe, multiple stripe, patterned configuration, or the like.

Looking back to FIG. 7, the panel 42 can be made to rest against at least one panel stop 50 which if used serves to prevent the panel 42 from swinging open into a hyperextended open position. The location of the panel stop or stops 50 working in conjunction with where the first end 72 is attached to the housing 22 defines an angle a taken through the center of the panel 42 with respect to the center of the cover 66. In some embodiments, this angle is about 45 degrees to about 65 degrees. In other embodiments the panel 42 is mounted such that it creates an angle relative to the cover of about 50 degrees to about 60 degrees. In still other embodiments the panel 42 is mounted such that it creates an angle relative to the cover of about 55 degrees. However, both larger and smaller angles are contemplated as well.

One item to note is that panel 42 is referred to throughout the specification as a panel. In many embodiments, this is desirable. However, in many possible embodiments, the panel 42 need not be a flat, planar structure. Curvilinear structures, bulbous structures, as well as other structures will serve the same purpose. In fact, a series of rigid structures or members placed between and serving to separate but connect the first end 72 to the second end 74 are all that is required. As such, the panel 42 may be made of various materials such as plastic, metal, wood, or the like, and may include cutouts such as cutouts 80 (FIG. 5) for the passage therethrough of other dispenser components as described later or for instance to optimize weight.

Looking specifically now to FIGS. 8 and 9, it can be seen that the blade 28 is mounted within the housing 22 to at least one wall such as front wall 112 shown on FIG. 1. The blade 28 may be disposed adjacent to the cover 66 in a manner in which the cover 66 is exterior to the blade 28 or such that the blade 28 is exterior to the cover 66 as shown in the FIGS. The blade 28 may have a smooth or serrated edge as desired.

Looking back to FIG. 7, when the cutting mechanism 64 is not being utilized, the cover 66 is in a position which at least partially covers the blade 28. This serves to protect the blade from damage caused by improper use or tampering. The cover 66 also includes a panel contact end 82 that is actuated by the first end 72 of the panel 42, when the first end 72 slidably engages the panel contact end 82 of the cover 66.

Figure 10:
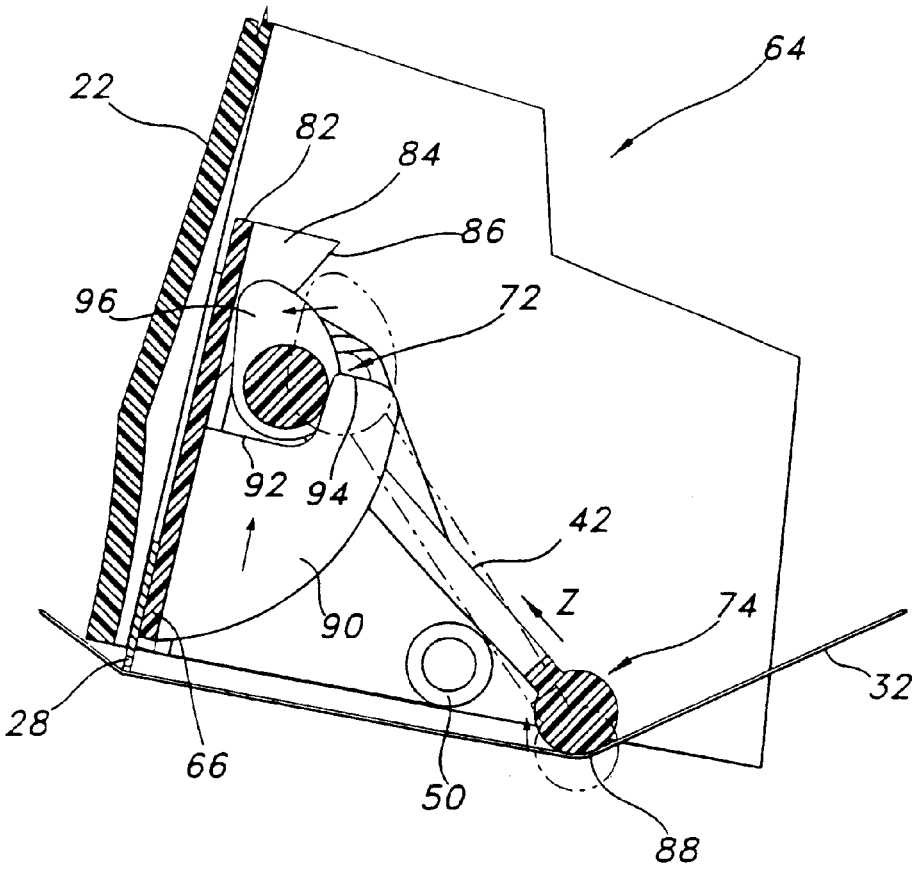
FIG. 10 is an end view of the cutting mechanism illustrating its use.

FIG. 10 illustrates the FIG. 7 cutting mechanism 64 during use. In the embodiment depicted, to dispense material 32 from the dispenser 20 the tail 34 is pulled some desired length from the dispenser 20. As the material 32 is paid off the roll 40 and pulled toward the blade 28, the material 32 contacts the second end 74. Continued pulling in this manner creates a force substantially coplanar with respect to the plane through both the first and second ends 72, 74 of the panel 42 along a Z direction. The force caused by pulling the material 32 displaces the entire panel 42 such that the first end 72 is urged toward the panel contact end 82 of the cover 66. The panel 42 is guided by the protrusions 76 (FIG. 8) as they slide in the opposed channels 78 located in or on the walls 106 or 108 of the housing 22 (best seen in FIG. 8). The panel 42 may also remain in sliding contact with the panel stops 50 as the panel is displaced toward the cover 66.

It should be understood that the actual force vector Z (FIG. 10) necessary to slidably move the first end 72 as described above depends at least in part upon the friction between the various moveable components. Therefore, the actual Z direction may range from about plus or minus 20 degrees from substantially coplanar. As a result, the term "substantially coplanar" should be considered to extend through at least this range.

Looking still to FIG. 10, it can be seen that the first end 72 acts as a cam to slidably engage a cam follower 84 with the panel contact end 82 of the cover 66. This results in the cover 66 lifting to expose the blade 28 and allowing the material 32 to be torn. In some embodiments, such as that shown in FIG. 10, the cam follower 84 may be in the form of at least one biased projection, for example inclined plane 86 which is affixed normal to the cover 66.

Once the material 32 is cut or otherwise dissociated from the roll 40, the removal of the force on the second end 74 results in the panel 42 sliding back to its original position, as shown in FIG. 7. At the same time, the cover 66 slides back to its original position.

Figure 11:
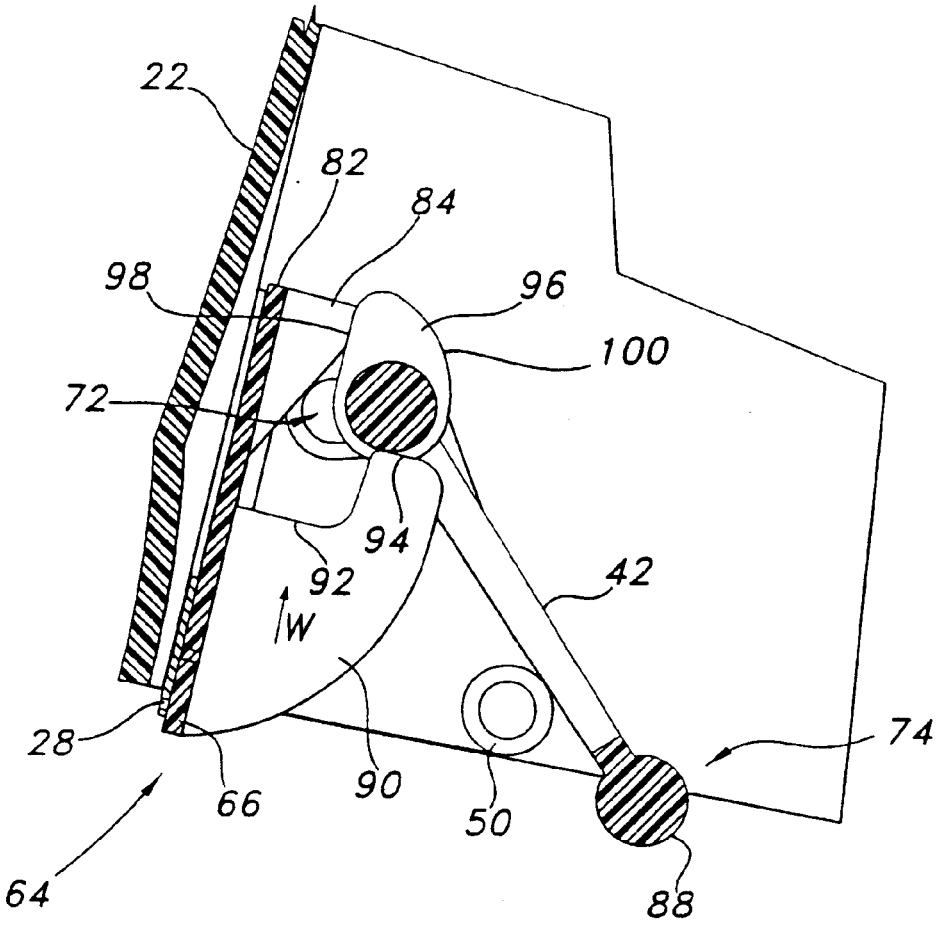
FIG. 11 is an end view of the cutting mechanism illustrating use of the cover stop.
Figure 12:
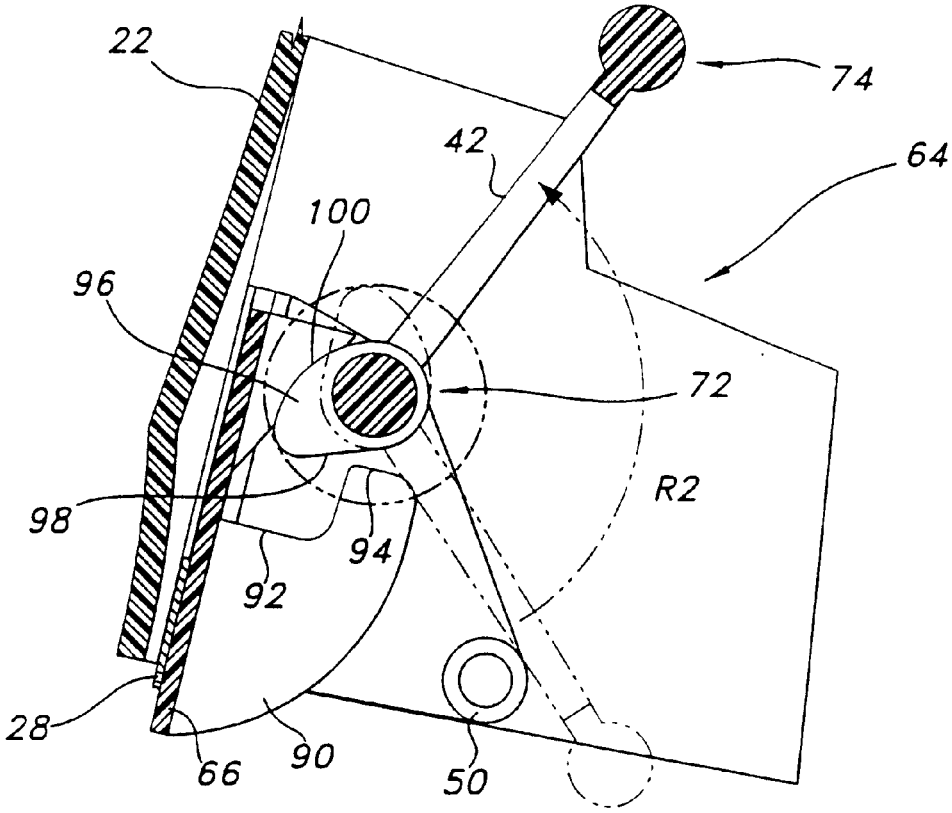
FIG. 12 is an end view of the cutting mechanism depicting pivoting of the panel and free rotation of the stabilizer.
Figure 13:
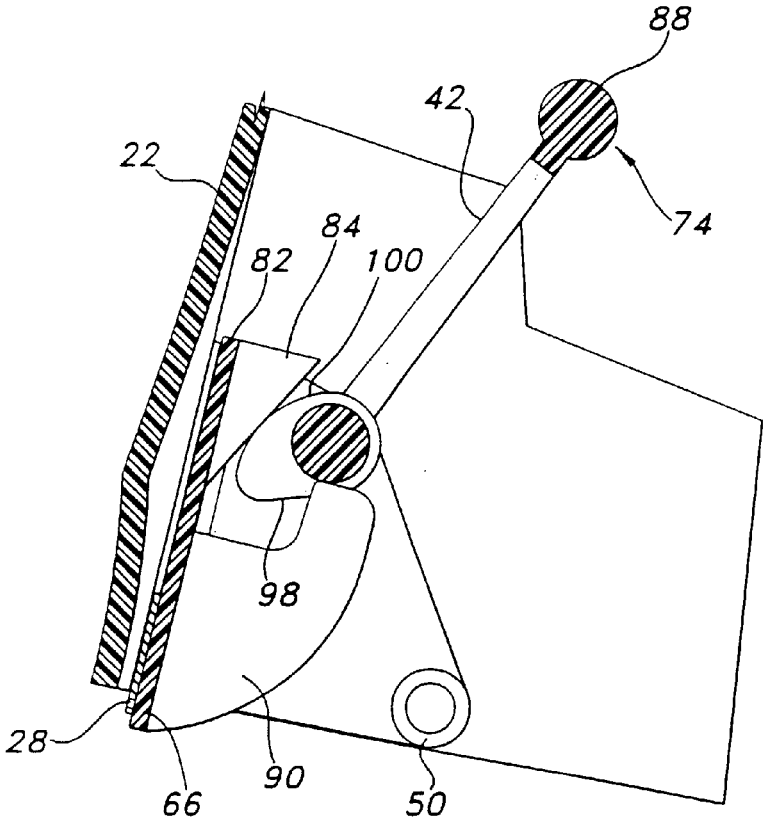
FIG. 13 is an end view of the cutting mechanism depicting use of the stabilizer.

FIGS. 11 through 13 depict further operation of the cutting mechanism 64. Additional features, such as those shown in FIGS. 11 through 13 might serve to enhance operation of the dispenser 20. For example, one such feature illustrated in FIG. 11 may be one or more cover stops 90. In one embodiment, the cover stop 90 could comprise a multi-step rigid plate having a first step 92 and a second step 94. The cover stop 90 would extend from and be affixed normal to the cover 66.

Looking still to FIG. 11, it can be seen that applying a force to the cover 66 in a direction W results in the cover 66, due to its connection to the cover stop 90, attempting to expose the blade 28. However, before the blade 28 can be exposed, the second step 94 interferes with this movement by contacting the first end 72 of the panel 42 in a manner that results in the blade 28 remaining concealed. In this embodiment, the force along direction W serves merely to urge the cover stop 90 against the first end 72 thus not exposing the blade 28 to damage.

Turning now to FIGS. 12 and 13, it can be seen that the first end 72 in this case may also include a stabilizer 96 having a profile which may include a linear portion 98 and a curved portion 100. The stabilizer 96 is positioned substantially normal to the cover 66, such that when the panel 42 pivots around the first end 72 in a direction R2, the stabilizer 96 rotates in conjunction with the first end 72. As the panel 42 is pivoted to a partially open position, the curved portion 100 rotates into a position near the panel contact end 82 of the cover 66, but does not contact it as depicted by the circle drawn in phantom on FIG. 12.

When the panel moves in the Z direction, the first end 72 of the panel 42 moves as previously described for FIG. 10. As the first end 72 slides by way of the protrusions 76 and channels 78, the second step 94 no longer is stopped by its contact with the first end 72 of the panel 42. The second step 94 aligns with the cutout or cutouts 80 depicted in FIG. 5 and the blade 28 is exposed. So long as the first end 72 of the panel moves along the Z direction the second step 94 passes through the complementarily positioned cutout 80 in the panel 42. Thus, the presence of the cover stop 90 does not impede the cutting function of the dispenser 20. The first step 92 if used serves to limit further travel of the cover 66 beyond that which is necessary to expose the cutting mechanism 28.

Additionally, as shown in FIG. 10, when the force along line Z is applied to the panel 42, as during dispensing, the linear portion 98 of the stabilizer 96 is urged against the cover 66. Rotation of the panel 42 is hindered and the sheet contact end 74 is stabilized for dissociating the material 32 from the roll 40.

Under actual operating conditions when the roll 40 has been completely dispensed, one may simply reach into the dispenser 20 and bend the core 52 so that the plungers 48 no longer extend into the core 52. The core 52 may then be removed from the dispenser 20 and discarded as desired. In some circumstances it is necessary to remove a full roll or a partially dispensed roll. Removal of a partially dispensed roll from the dispenser 20 is especially useful in situations where a period of heavy use of the dispenser 20 is anticipated, during which there may not be an opportunity to refill the dispenser. It may also be desirable to remove a full or partially dispensed roll 40 if it becomes contaminated.

Figure 14:
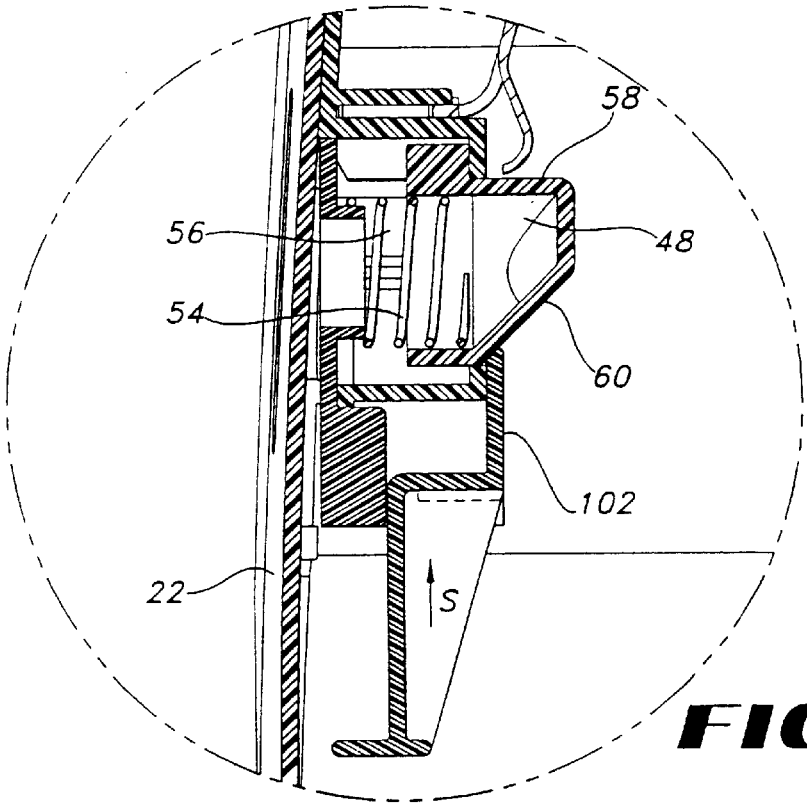
FIG. 14 is a front view of a portion of the dispenser illustrating a release bar when not in use.
Figure 15:
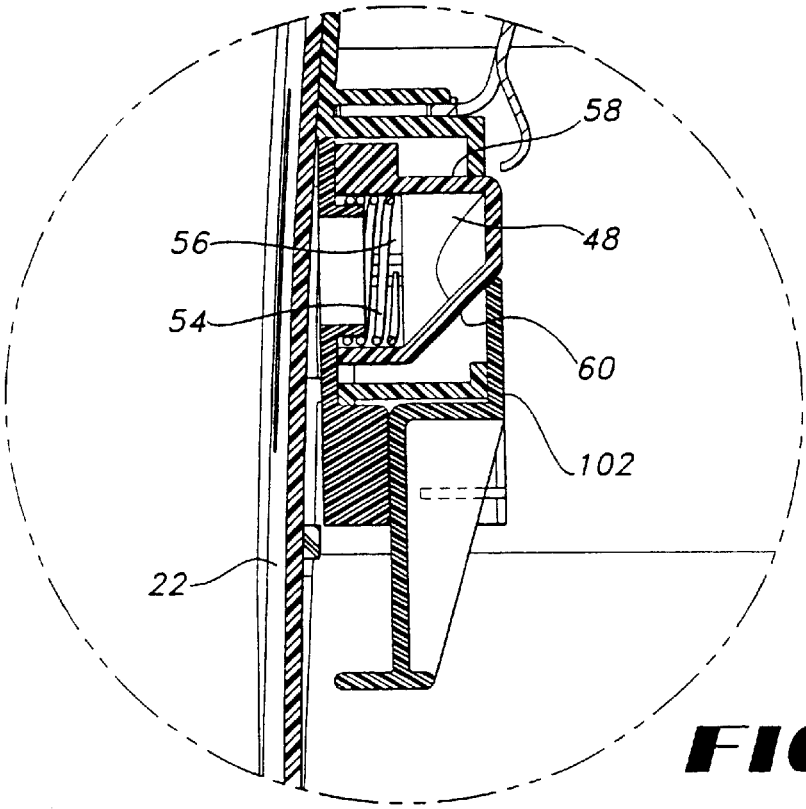
FIG. 15 is a front view of a portion of the dispenser illustrating a release bar in use.

To remove the full roll 40, the user must employ one or more release bars 102 as represented by FIG. 14 and FIG. 15. A release bar 102 operates in conjunction with the plunger 48 having a geometry adapted to depress upon pressure from the roll 40 being inserted into the dispenser 20. Thus, there may be one or more release bars 102, depending on the geometry of the plungers 46. In one embodiment, the release bar 102 slidably engages the plunger 48 when pushed in a direction S away from the opening 26. In other embodiments, the release bar 102 may be alternatively designed so that the user must manipulate it in a direction toward the opening 26 or toward any wall 106, 108, 110, or 112 of the dispenser 20 to activate the plunger 48.

To remove the roll 40, the user reaches into the dispenser 20 and actuates the release bar 102, forcing the compression of the plunger 48 against the spring 54 inside the cavity 56. The user then manually disengages the roll 40 from the opposing plunger 48 and with a downward force pulls the roll 40 from the housing 22. Where there is the release bar 102 for each of the opposing plungers 48, the simultaneous activation of both release bars 102 will cause both plungers 48 to disengage the core 52 of the roll 40. The roll 40 then drops downward from the dispenser 20 and may be removed. If the roll 40 is sufficiently large, it may not be able to pass through the opening 26 between the relaxed doors 40 and 42, so panel 42 or door 44 may need to be manually pushed upward to provide a sufficient opening 26 through which the roll 40 may be passed.

To remove a partially dispensed roll 40, the roll 40 is pushed upward within the dispenser 20 in a direction away from the opening 26. The exertion of force by the core 52 against the actuating surface 60 causes the plungers 48 to cam against the roll 40 as the roll 40 is removed from the dispenser 20, thereby depressing the plungers 48 against the spring 54 into the cavity 56. When the core of the roll 40 is no longer engaged, it is pushed toward the back of the housing 22, where it drops downward toward the opening 26 and is manually removed.

The invention may be embodied in other specific or equivalent forms without departing from the scope and spirit of the inventive characteristics thereof. The present embodiments therefore are to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A method for exposing and obstructing a blade comprising:

providing a panel having a first and a second end, a blade, and a blade cover, wherein the panel is both slidable and pivotable about the first end, and the blade cover obstructs access to the blade when the panel is in an at rest position;

applying a force at the second end thus moving the panel from the at rest position through a range of motions comprising:

sliding the panel toward the blade cover by application of the force substantially coplanar to a plane through the first and second ends thereby retracting the blade cover from the blade and exposing the blade and;

pivoting the panel about the first end by application of the force in a direction other than substantially coplanar to the lane through the first and second ends, thereby preventing retraction of the blade cover.

2. A method for exposing and obstructing a blade comprising:

providing a panel having a first and a second end, a blade, and a blade cover, wherein the panel is both slidable and pivotable about the first end, and the blade cover obstructs access to the blade when the panel is in an at rest positions;

wherein applying a force to the first end substantially coplanar to a plane through the first and second ends slides the panel into the blade cover thereby retracting the blade cover from the blade and exposing the blade and;

wherein applying a force to the first end not substantially coplanar to the plane through the first and second ends pivots the panel about the first end, thereby preventing retraction of the blade cover.

3. A method for cutting a material from a roll comprising:

pulling a length of material from a roll of material proximate to a movable panel having a first and a second end;

contacting the movable panel at the second end with a surface of the length of material;

displacing the movable panel toward a panel contact end of a cover by the application of a force substantially coplanar to a plane through the first and second ends imparted by the contact of the material against the second end of the panel;

moving the cover from a first position by pressing the first end of the panel into the panel contact end of the cover by the continued contact of the material against the second end of the panel;

exposing a blade when the cover is moved from the first position; and severing a portion of the length of material from the roll by pulling the material toward and across the blade, wherein applying a force to the second end in a direction other than substantially coplanar to the first and second ends causes the panel to pivot about the first end, not moving the cover and not exposing the blade.

* * * * *